US010955868B2

(12) United States Patent
Brule

(10) Patent No.: US 10,955,868 B2
(45) **Date of Patent: *Mar. 23, 2021**

(54) ZENER DIODE VOLTAGE REFERENCE CIRCUIT

(71) Applicant: NXP USA, Inc., Austin, TX (US)

(72) Inventor: Simon Brule, Toulouse (FR)

(73) Assignee: NXP USA, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,758

(22) Filed: Feb. 27, 2019

(65) Prior Publication Data

US 2019/0317542 A1 Oct. 17, 2019

(30) Foreign Application Priority Data

Apr. 13, 2018 (EP) ..... 18305459

(51) Int. Cl.
*G05F 3/18* (2006.01)
*G05F 3/26* (2006.01)

(52) U.S. Cl.
CPC ..... *G05F 3/185* (2013.01); *G05F 3/18* (2013.01); *G05F 3/267* (2013.01)

(58) Field of Classification Search
CPC ... G05F 3/18; G05F 3/185; G05F 3/20; G05F 3/245; G05F 3/26; G05F 3/267
USPC ..... 323/315
See application file for complete search history.

(56) References Cited

U.S. PATENT DOCUMENTS 4,283,674 A 8/1981 Kominami et al.
4,315,209 A 2/1982 Schmoock
4,352,056 A 9/1982 Cave et al.
5,568,368 A 10/1996 Steigerwald et al.
6,271,605 B1 8/2001 Carkner et al.
7,246,416 B2 * 7/2007 Duffy ..... A44B 18/0049 24/444
7,423,416 B1 * 9/2008 Quinones ..... G05F 3/18 323/314
7,426,416 B2 9/2008 Sri-Jayantha et al.
9,448,579 B2 9/2016 Marinca
10,281,946 B1 5/2019 Baranwal et al.
2004/0004992 A1 * 1/2004 Aota ..... G01K 7/01 374/163
2007/0252573 A1 11/2007 Tachibana et al.
2009/0059623 A1 3/2009 Cai
(Continued)

FOREIGN PATENT DOCUMENTS

GB 1401745 A * 7/1975 ..... G05F 3/18
JP H05100757 A 4/1993
WO 93/04423 A1 3/1993

OTHER PUBLICATIONS

U.S. Appl. No. 16/394,634, filed Apr. 25, 2019.
(Continued)

*Primary Examiner* — Peter M Novak

(57) ABSTRACT

An integrated circuit includes a voltage reference circuit including a Zener diode having a first terminal coupled to a first node and a second terminal coupled to a first voltage supply terminal. A proportional to absolute temperature (PTAT) circuit is coupled at the first node and configured to generate a PTAT current. A PTAT compensation circuit is coupled at the first node. The PTAT compensation circuit includes a first current mirror having a first branch coupled at the first node.

17 Claims, 3 Drawing Sheets

(56) References Cited

U.S. PATENT DOCUMENTS

| | | | | |
|---|---|---|---|---|
| 2011/0074495 | A1* | 3/2011 | Duval | G05F 3/30 327/539 |
| 2015/0102856 | A1 | 4/2015 | Barrett, Jr. et al. | |
| 2015/0177771 | A1 | 6/2015 | Marinca | |
| 2019/0317542 | A1 | 10/2019 | Brule | |

OTHER PUBLICATIONS

EP Application 19306379.9, filed Oct. 24, 2019, 21 pages.
Pryce, Dave, "EDN Special Report—Voltage References," No. 2, Jan. 13, 1990, pp. 120-126, and 128.
Non-Final Office Action for U.S. Appl. No. 16/394,634, dated Jan. 10, 2020, 36 pages.
Notice of Allowance for U.S. Appl. No. 16/394,634, dated Jun. 19, 2020, 17 pages.
U.S. Appl. No. 17/038,773, filed Sep. 30, 2020, 20 pages.
Hood, John L. Linsley, "LM109 three-terminal voltage regulator," Wireless World, vol. 88, No. 1554, Mar. 1, 1982, pp. 41-44.

* cited by examiner

ZENER DIODE VOLTAGE REFERENCE CIRCUIT

BACKGROUND

Field

This disclosure relates generally to semiconductor devices, and more specifically, to Zener diode voltage reference circuitry in semiconductor devices.

Related Art

Today, it is important to include a stable reference voltage generator on an integrated circuit (IC) die, or chip. For example, circuits that provide a stable reference voltage are used in data converters, analog devices, sensors, and many other applications. These circuits require voltage generators that are stable over manufacturing process variations, supply voltage variations, and operating temperature variations. Such voltage generators can be implemented without modifications of conventional manufacturing processes. However, voltage generator circuits can be affected by packaging stresses and extended temperature ranges.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Generally, there is provided, Zener diode voltage reference circuitry implemented on a semiconductor integrated circuit that generates a substantially constant reference voltage over an extended temperature range (e.g., −40 to 150° C.). A Zener diode coupled to a proportional to absolute temperature (PTAT) circuit generates a reference voltage based on a bias current. A PTAT current compensation circuit injects current based on a mirrored current from the PTAT circuit. The injected current serves to stabilize the Zener diode biasing current allowing for significant improvement to the linearity of the reference voltage over the extended temperature range.

Figure 1:
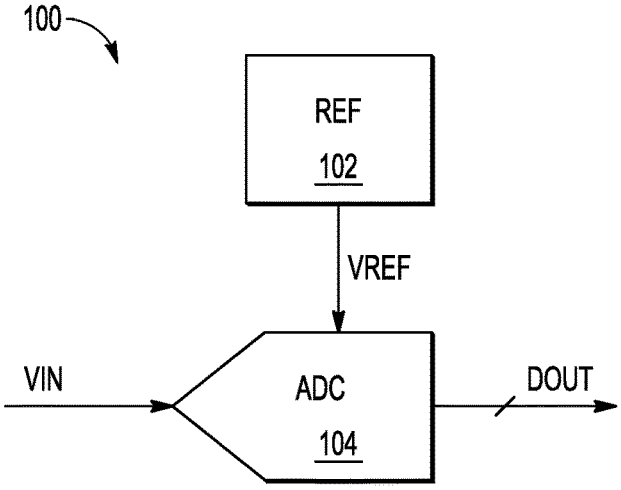
FIG. 1 illustrates, in block diagram form, exemplary analog-to-digital converter (ADC) system in accordance with an embodiment of the present invention.

FIG. 1 illustrates, in block diagram form, exemplary analog-to-digital converter (ADC) system 100 in accordance with an embodiment of the present disclosure. The ADC system 100 includes voltage reference circuit 102 and ADC circuit 104. Voltage reference circuit 102 is generally coupled to provide a reference voltage (VREF) to digital-to-analog conversion circuitry (not shown) in the ADC circuit 104.

Voltage reference circuit 102 includes an output for providing reference voltage signal labeled VREF. The ADC circuit 104 includes a first input coupled to receive an analog input voltage, a second input coupled to receive the VREF voltage signal, and an output for providing a digital value which can be used by a processor, for example. The ADC circuit 104 may be any type of ADC such as successive approximation register (SAR), sigma delta, and flash, for example. Voltage reference circuit 102 may be coupled to provide the VREF voltage signal to any suitable circuitry requiring a stable reference voltage.

Figure 2:
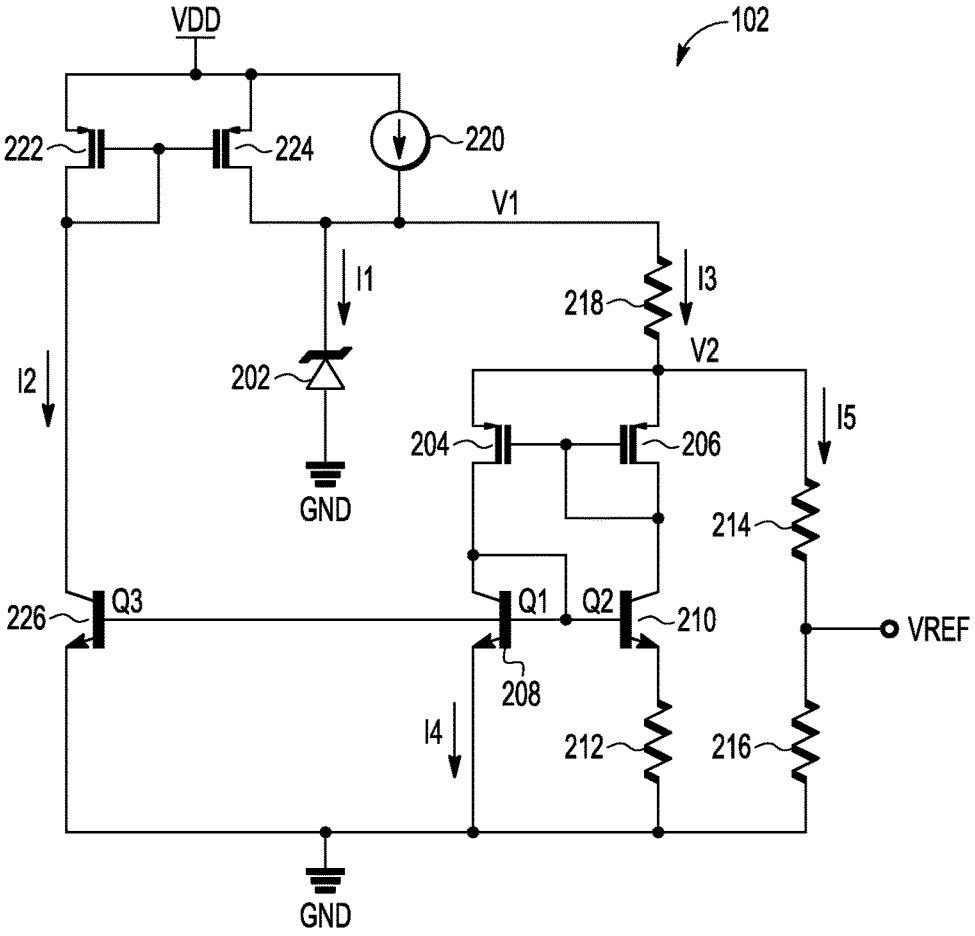
FIG. 2 illustrates, in schematic diagram form, exemplary voltage reference circuit in accordance with an embodiment of the present invention.

FIG. 2 illustrates, in schematic diagram form, exemplary voltage reference circuit 102 in accordance with an embodiment of the present disclosure. Voltage reference circuit 102 includes Zener diode 202, a proportional to absolute temperature (PTAT) circuit, an output voltage divider, a bias current source 220, and a PTAT current compensation circuit. Voltage reference circuit 102 is coupled to a first voltage supply terminal labeled VDD and a second voltage supply terminal labeled GND, and provides reference voltage VREF at output terminal labeled VREF. A nominal operating voltage, typically referred to as VDD, may be provided at the first voltage supply terminal. The first voltage supply terminal may also be referred to as a VDD supply terminal. A 0-volt or ground voltage may be provided at the second voltage supply terminal. The second voltage supply terminal may also be referred to as a GND supply terminal or a ground supply terminal.

The PTAT circuit includes P-channel metal oxide semiconductor field effect transistors (MOSFETs) 204 and 206, NPN bipolar junction transistors (BJTs) 208 and 210 (Q2 and Q1), and resistor 212. Transistors 204 and 206 are configured to form a first current mirror. A first current electrode of each of transistors 204 and 206 is coupled at node labeled V2. A second current electrode of transistor 206 is coupled to control electrodes of transistor 204 and 206. Transistors 208 and 210 are configured to form a second current mirror with NPN BJT 226 (Q3) of the PTAT current compensation circuit. A second current electrode of transistor 204 is coupled to a first current electrode (e.g., collector) of transistor 208 and control electrodes (e.g., base) of transistors 208 and 210. A second current electrode (e.g., emitter) of transistor 208 is coupled to the GND supply terminal. A second current electrode of transistor 210 is coupled to a first terminal of resistor 212 and a second terminal of resistor 212 is coupled to the GND supply terminal.

The output voltage divider is coupled to the PTAT circuit at node V2. The output voltage divider includes resistors 214-216 configured to provide a reference voltage of approximately 1.25 volts at the VREF output terminal. In some embodiments, the output voltage divider may be configured to provide reference voltages other than 1.25 volts. A first terminal of resistor 214 is coupled at node V2 and a second terminal of resistor 214 is coupled to a first terminal of resistor 216 at VREF output terminal. A second terminal of resistor 216 is coupled to the GND supply terminal. Resistor 218 is coupled between node V1 and the PTAT circuit at node V2. A first terminal of resistor 218 is coupled at node labeled V1 and a second terminal of resistor 218 is coupled at node V2.

The Zener diode 202 is coupled at node V1. The Zener diode 202 includes a first terminal (e.g., cathode) coupled at node V1 and a second terminal (e.g., anode) coupled to the GND supply terminal. The current source 220 is also coupled at node V1 and is configured to provide a bias current for the Zener diode 202. The current source 220 includes a first terminal (e.g., input) coupled to the VDD supply terminal and a second terminal (e.g., output) coupled at node V1.

PTAT current compensation circuit includes P-channel MOSFETs 222 and 224 and NPN BJT 226 (Q3). Transistors 222 and 224 are arranged to form a current mirror having a first branch (e.g., mirrored current branch) coupled at node V1 and a second branch coupled to transistor 226. A first current electrode of transistor 222 is coupled to the VDD supply terminal and a second current electrode of transistor 222 is coupled to control electrodes of transistors 222 and 224 and to a first current electrode (e.g., collector) of transistor 226. A first current electrode of transistor 224 is coupled to the VDD supply terminal and a second current electrode of transistor 224 is coupled at node V1. A second current electrode (e.g., emitter) of transistor 226 is coupled to the GND supply terminal. A control electrode (e.g., base) of transistor 226 is coupled to the control electrode and first current electrode of transistor 208 forming a current mirror whereby second branch current I2 is a mirrored current of current I4. PTAT current compensation circuit is configured to provide a current to the PTAT circuit by way of current sourced though transistor 224.

In the exemplary voltage reference circuit 102, BJT Q2 of the PTAT circuit is configured with an emitter area eight times larger than BJT Q1. For example, Q2 may be formed as seven transistors of Q1 size connected in parallel, thus establishing an 8:1 ratio of current densities Q1:Q2. In some embodiments, Q2 may be configured to establish other ratios of current densities with Q1. BJT Q3 of the PTAT current compensation circuit is configured to have the same size as Q1. Transistor 224 of the PTAT current compensation circuit is configured to have twice the width dimension of transistor 222. For example, transistor 224 may be formed as two transistors (of transistor 222 size) connected in parallel. In some embodiments, Q3 and transistors 222 and 224 may be configured to have other size relationships.

In operation, current source 220 provides a bias current I1 for the Zener diode 202 and a bias current I5 for output voltage divider resistors 214-216, while the PTAT current compensation circuitry provides current (2*I4) for the PTAT circuit. Because the PTAT current compensation circuitry provides current for the PTAT circuitry, and because the voltage at node V2 remains constant over temperature, the Zener diode bias current is stabilized allowing for significantly improved linearity over temperature. A Zener voltage is generated at node V1 and a reference voltage VREF is provided at the output terminal. In this embodiment, the Zener voltage at node V1 is approximately 5.0 volts and the VREF voltage is approximately 1.25 volts. In some embodiments, other Zener and VREF voltages may be generated. The PTAT circuit, by way of a difference between current densities of Q1 and Q2, generates a PTAT current I4 (e.g., $\Delta V_{BE}$/resistor 212). The PTAT current I4 establishes a PTAT voltage across resistor 218, compensating for Zener voltage variation over temperature and resulting in a stable voltage at node V2. Because Q3 is configured in a current mirror arrangement with Q1 and Q2, the Q1 branch current I4 is mirrored to establish the Q3 branch current I2 of the PTAT current compensation circuit. In turn, a current established through transistor 224 serves as a current source for biasing the PTAT circuitry.

Figure 3:
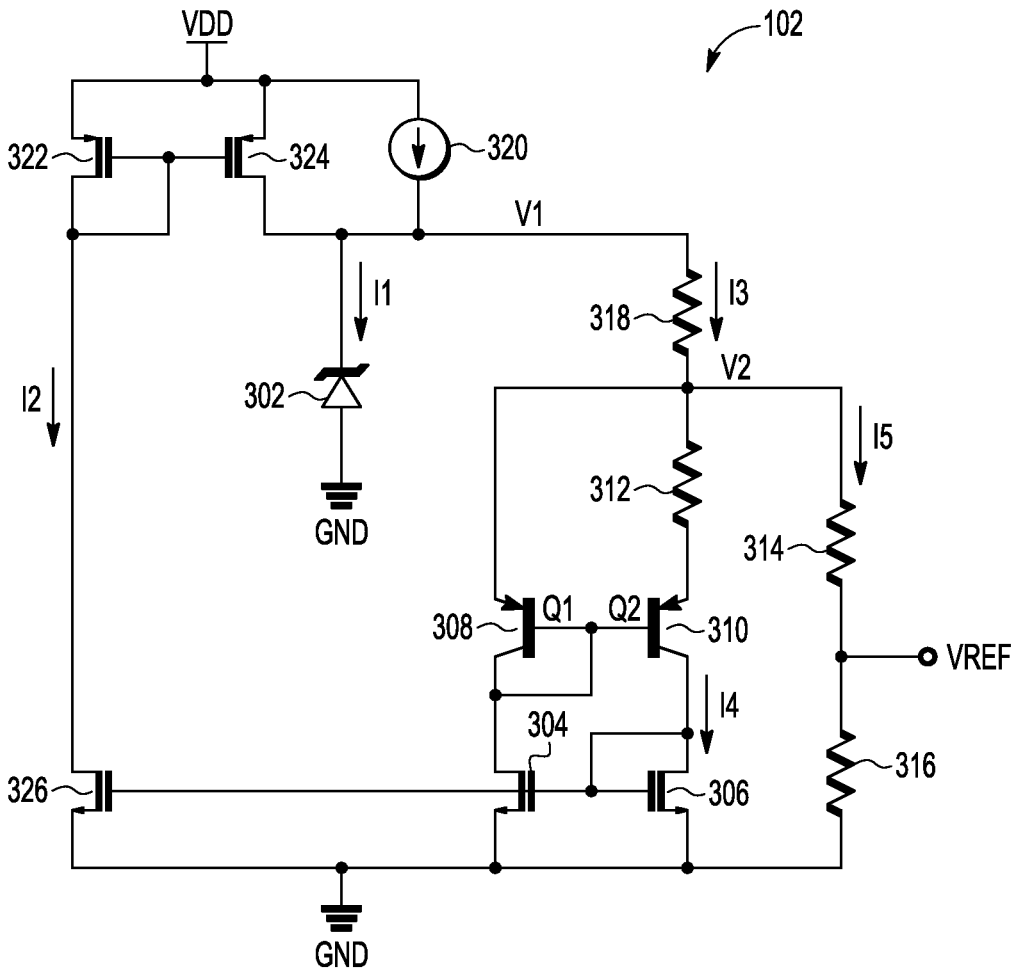
FIG. 3 illustrates, in schematic diagram form, exemplary voltage reference circuit in accordance with an alternative embodiment of the present invention.

FIG. 3 illustrates, in schematic diagram form, exemplary voltage reference circuit 102 in accordance with an alternative embodiment of the present disclosure. Voltage reference circuit 102 includes Zener diode 302, a proportional to absolute temperature (PTAT) circuit, an output voltage divider, a bias current source 320, and a PTAT current compensation circuit. Voltage reference circuit 102 is coupled to a first voltage supply terminal labeled VDD and a second voltage supply terminal labeled GND, and provides reference voltage VREF at output terminal labeled VREF. A nominal operating voltage, typically referred to as VDD, may be provided at the first voltage supply terminal. The first voltage supply terminal may also be referred to as a VDD supply terminal. A 0-volt or ground voltage may be provided at the second voltage supply terminal. The second voltage supply terminal may also be referred to as a GND supply terminal or a ground supply terminal.

The PTAT circuit includes N-channel MOSFETs 304 and 306, PNP BJTs 308 and 310 (Q2 and Q1), and resistor 312. Transistors 304 and 306 are configured to form a first current mirror with N-channel MOSFET 326 of the PTAT current compensation circuit. A first current electrode of each of transistors 304 and 306 is coupled to the GND supply terminal. A second current electrode of transistor 306 is coupled to control electrodes of transistor 304 and 306. Transistors 308 and 310 are configured to form a second current mirror. A second current electrode of transistor 304 is coupled to a first current electrode (e.g., collector) of transistor 308 and control electrodes (e.g., base) of transistors 308 and 310. A second current electrode (e.g., emitter) of transistor 308 is coupled at node V2. A second current electrode of transistor 310 is coupled to a first terminal of resistor 312 and a second terminal of resistor 312 is coupled at node V2.

The output voltage divider is coupled to the PTAT circuit at node V2. The output voltage divider includes resistors 314-316 configured to provide a reference voltage of approximately 1.25 volts at the VREF output terminal. In some embodiments, the output voltage divider may be configured to provide reference voltages other than 1.25 volts. A first terminal of resistor 314 is coupled at node V2 and a second terminal of resistor 314 is coupled to a first terminal of resistor 316 at VREF output terminal. A second terminal of resistor 316 is coupled to the GND supply terminal. Resistor 318 is coupled between node V1 and the PTAT circuit at node V2. A first terminal of resistor 318 is coupled at node V1 and a second terminal of resistor 318 is coupled at node V2.

The Zener diode 302 is coupled at node V1. The Zener diode 302 includes a first terminal (e.g., cathode) coupled at node V1 and a second terminal (e.g., anode) coupled to the GND supply terminal. The current source 320 is also coupled at node V1 and is configured to provide a bias current for the Zener diode 302. The current source 320 includes a first terminal (e.g., input) coupled to the VDD supply terminal and a second terminal (e.g., output) coupled at node V1.

PTAT current compensation circuit includes P-channel MOSFETs 322 and 324 and N-channel MOSFET 326. Transistors 322 and 324 are arranged to form a current mirror having a first branch (e.g., mirrored current branch) coupled at node V1 and a second branch coupled to transistor 326. A first current electrode of transistor 322 is coupled to the VDD supply terminal and a second current electrode of transistor 322 is coupled to control electrodes of transistors 322 and 324 and to a first current electrode of transistor 326. A first current electrode of transistor 324 is coupled to the VDD supply terminal and a second current electrode of transistor 324 is coupled at node V1. A second current electrode of transistor 326 is coupled to the GND supply terminal. A control electrode of transistor 326 is coupled to the control electrode and second current electrode of transistor 306 forming a current mirror whereby second branch current I2 is a mirrored current of current I4. PTAT current compensation circuit is configured to provide a current to the PTAT by way of current sourced though transistor 324.

In the exemplary voltage reference circuit 102, BJT Q2 of the PTAT circuit is configured with an emitter area eight times larger than BJT Q1. For example, Q2 may be formed as seven transistors of Q1 size connected in parallel, thus establishing an 8:1 ratio of current densities Q1:Q2. In some embodiments, Q2 may be configured to establish other ratios of current densities with Q1. Transistor 326 of the PTAT current compensation circuit is configured to have the same size as transistor 306. Transistor 324 of the PTAT current compensation circuit is configured to have twice the width dimension of transistor 322. For example, transistor 324 may be formed as two transistors (of transistor 322 size) connected in parallel. In some embodiments, transistors 322-326 may be configured to have other size relationships.

In operation, current source 320 provides a bias current for the Zener diode 302 and a bias current I5 for output voltage divider resistors 314-316, while the PTAT current compensation circuitry provides current for the PTAT circuit. Because the PTAT current compensation circuitry provides current for the PTAT circuitry, and because the voltage at node V2 remains constant over temperature, the Zener diode bias current is stabilized allowing for significantly improved linearity over temperature. A Zener voltage is generated at node V1 and a reference voltage VREF is provided at the output terminal. In this embodiment, the Zener voltage at node V1 is approximately 5.0 volts and the VREF voltage is approximately 1.25 volts. In some embodiments, other Zener and VREF voltages may be generated. The PTAT circuit, by way of a difference between current densities of Q1 and Q2, generates a PTAT current I4 (e.g., $\Delta V_{BE}$/resistor 312). The PTAT current I4 establishes a PTAT voltage across resistor 318, compensating for Zener voltage variation over temperature and resulting in a stable voltage at node V2. Because transistor 326 is configured in a current mirror arrangement with transistors 304 and 306, the Q2 branch current I4 is mirrored to establish the branch current I2 of the PTAT current compensation circuit. In turn, a current established through transistor 324 serves as a current source for biasing the PTAT circuitry.

Figure 4:
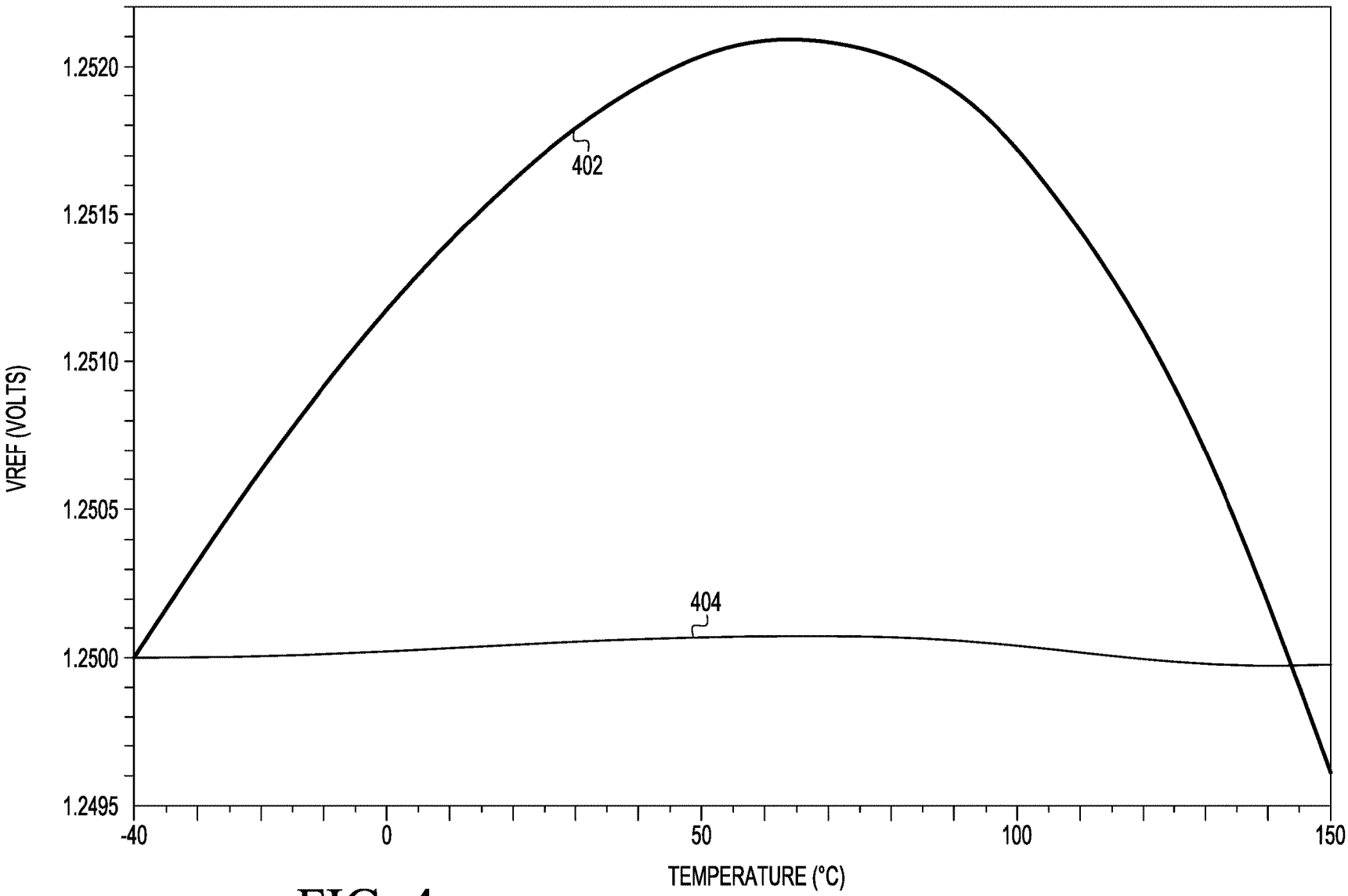
FIG. 4 illustrates, in plot diagram form, exemplary reference voltages versus temperature in accordance with an embodiment of the present invention.

FIG. 4 illustrates, in plot diagram form, exemplary reference voltage VREF versus temperature in accordance with an embodiment of the present invention. Temperature values are shown in degrees Centigrade (° C.) on the X-axis, and VREF voltage values are shown on the Y-axis. The plot diagram of FIG. 4 includes plots 402 and 404 depicting simulation results of VREF generated voltages versus temperature. In this example, plot 402 shows VREF voltage output from a known Zener diode reference voltage generator without PTAT current compensation varying by more than 2 millivolts (mV) with temperature. In contrast, plot 404 shows VREF voltage output from exemplary voltage reference circuit 102 varying by less than 0.1 mV with temperature. Because the voltage reference circuit 102 includes PTAT current compensation circuitry to provide bias current for the PTAT circuit, the Zener diode bias current remains stable allowing for the VREF voltage output to have a substantially flat, constant relationship with temperature.

Generally, there is provided, a voltage reference circuit including a Zener diode having a first terminal coupled to a first node and a second terminal coupled to a first voltage supply terminal; a proportional to absolute temperature (PTAT) circuit coupled at the first node, the PTAT circuit configured to generate a PTAT current; and a PTAT compensation circuit coupled at the first node, the PTAT compensation circuit comprising a first current mirror having a first branch coupled at the first node. The first current mirror of the PTAT compensation circuit may further include a second branch coupled to a first current electrode of a first transistor. The PTAT circuit may include a second current mirror coupled to a control electrode of the first transistor. The first transistor and transistors forming the second current mirror may be characterized as bipolar junction transistors (BJTs). The reference circuit may further include a current source having an input coupled to a second voltage supply terminal and an output coupled at the first node. The first current mirror of the PTAT compensation circuit may include: a first transistor having a first current electrode coupled to the second voltage supply terminal and a second current electrode coupled to form a first branch at the first node; and a second transistor having a first current electrode coupled to the second voltage supply terminal and a second current electrode coupled to control electrodes of the first and second transistors. The reference may further include a first resistor having a first terminal coupled at the first node and a second terminal coupled at a second node, the PTAT current establishing a PTAT voltage across the first resistor. The reference circuit may further include a voltage divider coupled between the second node and the first voltage supply terminal, the voltage divider configured to provide a reference voltage at an output terminal. The first terminal of the Zener diode may be characterized as a cathode and the second terminal of the Zener diode may be characterized as an anode.

In another embodiment, there is provided, a voltage reference circuit including a Zener diode having a first terminal coupled to a first node and a second terminal coupled to a first voltage supply terminal; a proportional to absolute temperature (PTAT) circuit coupled at the first node, the PTAT circuit configured to generate a PTAT current; and a PTAT compensation circuit coupled at the first node, the PTAT compensation circuit including: a first transistor having a first current electrode coupled to a second voltage supply terminal and a second current electrode coupled at the first node; and a second transistor having a first current electrode coupled to the second voltage supply terminal and a second current electrode coupled to control electrodes of the first and second transistors; and a third transistor having a first current electrode coupled to the second current electrode of the second transistor, a control electrode coupled to the PTAT circuit, and a second current electrode coupled to the first voltage supply terminal. The PTAT circuit may include a first current mirror coupled to the control electrode of the third transistor, the first current mirror and the third transistor arranged to cause a mirrored current to flow through the third transistor. The reference circuit may further include a current source having an input coupled to the second voltage supply terminal and an output coupled at the first node. The first terminal of the Zener diode may be characterized as a cathode and the second terminal of the Zener diode may be characterized as an anode. The reference circuit may further include a first resistor having a first terminal coupled at the first node and a second terminal coupled at a second node, the PTAT current establishing a PTAT voltage across the first resistor. The reference circuit may further include a voltage divider coupled between the second node and the first voltage supply terminal, the voltage divider including: a second resistor having a first terminal coupled at the second node and a second terminal coupled at an output terminal; and a third resistor having a first terminal coupled to the output terminal and a second terminal coupled to the first voltage supply terminal. The output terminal may be coupled to an input terminal of an analog-to-digital converter. The reference circuit may be configured to provide a reference voltage of 1.25 volts at the output terminal.

In yet another embodiment, there is provided, a method of generating a reference voltage including providing a Zener diode coupled between a first node and a first voltage supply terminal; generating a proportional to absolute temperature (PTAT) current by way of a PTAT circuit coupled at the first node, the PTAT current establishing a PTAT voltage across a first resistor coupled at the first node; and injecting a PTAT compensation current at the first node by way of a PTAT compensation circuit coupled at the first node, the PTAT compensation circuit comprising: a first transistor having a first current electrode coupled to a second voltage supply terminal and a second current electrode coupled at the first node; and a second transistor having a first current electrode coupled to the second voltage supply terminal and a second current electrode coupled to control electrodes of the first and second transistors; and a third transistor having a first current electrode coupled to the second current electrode of the second transistor, a control electrode coupled to the PTAT circuit, and a second current electrode coupled to the first voltage supply terminal. The PTAT compensation current may be based on a mirrored current through the third transistor. The method may further include generating the reference voltage at an output of a voltage divider circuit coupled to the PTAT circuit.

By now it should be appreciated that there has been provided, Zener diode voltage reference circuitry implemented on a semiconductor integrated circuit that generates a substantially constant reference voltage over an extended temperature range (e.g., −40 to 150° C.). A Zener diode coupled to a proportional to absolute temperature (PTAT) circuit generates a reference voltage based on a bias current. A PTAT current compensation circuit injects current based on a mirrored current from the PTAT circuit. The injected current serves to stabilize the Zener diode biasing current allowing for significant improvement to the linearity of the reference voltage over the extended temperature range.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

The invention claimed is:

1. A voltage reference circuit comprising:

a Zener diode having a first terminal coupled to a first node and a second terminal coupled to a first voltage supply terminal (GND);

a proportional to absolute temperature (PTAT) circuit coupled at the first node, the PTAT circuit configured to generate a PTAT current; and a PTAT compensation circuit coupled at the first node, the PTAT compensation circuit comprising a first current mirror having a first branch coupled at the first node, wherein the first current mirror of the PTAT compensation circuit comprises:

a first transistor having a first current electrode coupled to a second voltage supply terminal (VDD) and a second current electrode coupled to form the first branch at the first node; and a second transistor having a first current electrode coupled to the second voltage supply terminal and a second current electrode coupled to control electrodes of the first and second transistors, wherein the first current mirror of the PTAT compensation circuit further comprises a second branch coupled to the first current electrode of a third transistor, and the PTAT circuit comprises a second current mirror coupled to a control electrode of the third transistor.

2. The voltage reference circuit of claim 1, wherein first and second transistors forming the second current mirror are characterized as bipolar junction transistors (BJTs).

3. The voltage reference circuit of claim 1, further comprising a first resistor having a first terminal coupled at the first node and a second terminal coupled at a second node, the PTAT current establishing a PTAT voltage across the first resistor.

4. The voltage reference circuit of claim 3, further comprising a voltage divider coupled between the second node and the first voltage supply terminal, the voltage divider configured to provide a reference voltage at an output terminal.

5. The voltage reference circuit of claim 4, the voltage divider comprising:

a second resistor having a first terminal coupled at the second node and a second terminal coupled at an output terminal; and a third resistor having a first terminal coupled to the output terminal and a second terminal coupled to the first voltage supply terminal.

6. The voltage reference circuit of claim 5, wherein the output terminal is coupled to an input terminal of an analog-to-digital converter.

7. The voltage reference circuit of claim 1, wherein the first terminal of the Zener diode is characterized as a cathode and the second terminal of the Zener diode is characterized as an anode.

8. The voltage reference circuit of claim 1, wherein the first current mirror of the PTAT compensation circuit further comprises:

a third transistor having a first current electrode coupled to the second current electrode of the second transistor, a control electrode coupled to the PTAT circuit, and a second current electrode coupled to the first voltage supply terminal.

9. The voltage reference circuit of claim 1, further comprising a current source having an input coupled to the second voltage supply terminal and an output coupled at the first node.

10. A method of generating a reference voltage, the method comprising:

providing a Zener diode coupled between a first node and a first voltage supply terminal;

generating a proportional to absolute temperature (PTAT) current by way of a PTAT circuit coupled at the first node, the PTAT current establishing a PTAT voltage across a first resistor coupled at the first node; and injecting a PTAT compensation current at the first node by way of a PTAT compensation circuit coupled at the first node, the PTAT compensation circuit comprising:

a first transistor having a first current electrode coupled to a second voltage supply terminal and a second current electrode coupled at the first node; and a second transistor having a first current electrode coupled to the second voltage supply terminal and a second current electrode coupled to control electrodes of the first and second transistors; and a third transistor having a first current electrode coupled to the second current electrode of the second transistor, a control electrode coupled to the PTAT circuit, and a second current electrode coupled to the first voltage supply terminal.

11. The method of claim 10, wherein the PTAT compensation current is based on a mirrored current through the third transistor.

12. The method of claim 10, further comprising generating the reference voltage at an output of a voltage divider coupled to the PTAT circuit.

13. A semiconductor device comprising:

a Zener diode-coupled between a first node- and a first voltage supply terminal;

a PTAT circuit coupled at the first node, the PTAT current establishing a PTAT voltage across a first resistor coupled at the first node to generate a proportional to absolute temperature (PTAT) current; and a PTAT compensation circuit coupled at the first node to inject a PTAT compensation current at the first node, the PTAT compensation circuit comprising:

a first transistor having a first current electrode coupled to a second voltage supply terminal and a second current electrode coupled at the first node; and a second transistor having a first current electrode coupled to the second voltage supply terminal and a second current electrode coupled to control electrodes of the first and second transistors; and a third transistor having a first current electrode coupled to the second current electrode of the second transistor, a control electrode coupled to the PTAT circuit, and a second current electrode coupled to the first voltage supply terminal.

14. The semiconductor device of claim 13, wherein the PTAT compensation current is based on a mirrored current through the third transistor.

15. The semiconductor device of claim 13, wherein the reference voltage is generated at an output of a voltage divider coupled to the PTAT circuit.

16. The semiconductor device of claim 13, the first resistor having a first terminal coupled at the first node and a second terminal coupled at a second node, the PTAT current establishing a PTAT voltage across the first resistor.

17. The semiconductor device of claim 16, further comprising a voltage divider coupled between the second node and the first voltage supply terminal, the voltage divider configured to provide a reference voltage at an output terminal.

* * * * *